US009719298B2

(12) United States Patent
Fraser et al.

(10) Patent No.: US 9,719,298 B2
(45) Date of Patent: Aug. 1, 2017

(54) TILT MECHANISM FOR A WINDOW BLIND

(71) Applicant: Hunter Douglas Inc., Pearl River, NY (US)

(72) Inventors: Donald E. Fraser, Owensboro, KY (US); Richard N. Anderson, Whitesville, KY (US)

(73) Assignee: HUNTER DOUGLAS INC., Pearl River, NY (US)

( * ) Notice: Subject to any disclaimer, the term of this patent is extended or adjusted under 35 U.S.C. 154(b) by 0 days.

(21) Appl. No.: 14/930,256

(22) Filed: Nov. 2, 2015

(65) Prior Publication Data

US 2016/0123075 A1 May 5, 2016

Related U.S. Application Data

(60) Provisional application No. 62/074,688, filed on Nov. 4, 2014.

(51) Int. Cl.

| | |
|---|---|
| ***E06B 9/303*** | (2006.01) |
| ***E06B 9/384*** | (2006.01) |
| ***E06B 9/322*** | (2006.01) |
| ***E06B 9/28*** | (2006.01) |

(52) U.S. Cl.

CPC ..... *E06B 9/384* (2013.01); *E06B 9/28* (2013.01); *E06B 9/322* (2013.01); *E06B 2009/285* (2013.01)

(58) Field of Classification Search

CPC ..... E06B 9/307; E06B 9/384; E06B 9/303; E06B 2009/285; E06B 9/28; E06B 9/322

USPC ..... 160/174 R, 176.1 R, 177 R, 178.1 R

See application file for complete search history.

(56) References Cited

U.S. PATENT DOCUMENTS

| | | | | | |
|---|---|---|---|---|---|
| 221,337 | A | * | 11/1879 | Metcalf | E06B 9/307 160/176.1 R |
| 262,399 | A | * | 8/1882 | Gibson | E06B 9/382 160/168.1 R |
| 663,530 | A | * | 12/1900 | Wilson | E06B 9/307 160/170 |
| 664,451 | A | * | 12/1900 | Alford | E06B 9/327 160/172 R |
| 1,747,891 | A | * | 2/1930 | Dunn | E06B 9/327 160/172 R |
| 1,933,708 | A | * | 11/1933 | Cooper | E06B 9/307 160/176.1 R |
| 2,003,174 | A | * | 5/1935 | Cooper | E06B 9/307 160/176.1 R |
| 2,061,373 | A | * | 11/1936 | Brent | E06B 9/305 160/172 R |
| 2,162,226 | A | * | 6/1939 | McKinney | E06B 9/382 160/115 |
| 4,168,735 | A | * | 9/1979 | Frei | E06B 9/302 160/176.1 R |
| 4,484,611 | A | * | 11/1984 | Anderson | E06B 9/28 160/107 |

(Continued)

*Primary Examiner* — Katherine Mitchell
*Assistant Examiner* — Johnnie A Shablack
(74) *Attorney, Agent, or Firm* — Dority & Manning, P.A.

(57) ABSTRACT

A blind is arranged such that minimal force is required to rotate the tilt drum to tilt the slats from the fully open to the fully closed position and back, with each of the front and rear tilt cables sharing the load nearly equally throughout the entire path from the fully open to the fully closed position and back.

18 Claims, 12 Drawing Sheets

(56) References Cited

U.S. PATENT DOCUMENTS 4,494,593 A * 1/1985 Fielder, Jr. ..... E06B 9/307 160/177 R
4,502,523 A * 3/1985 Anderson ..... E06B 9/28 160/107
4,515,201 A * 5/1985 Anderson ..... E06B 9/28 160/107
4,651,794 A * 3/1987 Bytheway, Jr. ..... E06B 9/303 160/115
4,697,629 A 10/1987 Anderson
4,697,630 A * 10/1987 Rude ..... E06B 9/307 160/176.1 R
4,708,188 A * 11/1987 Bytheway, Jr. ..... E06B 9/303 160/166.1
4,821,789 A * 4/1989 Van Rens ..... E06B 9/307 160/176.1 R
5,074,349 A * 12/1991 Yannazzone ..... E06B 9/307 160/176.1 R
5,139,073 A 8/1992 Opdahl
5,232,037 A * 8/1993 Fraser ..... E06B 9/307 160/115
5,285,838 A * 2/1994 Rapp ..... E06B 9/303 160/168.1 R
5,341,865 A * 8/1994 Fraser ..... E06B 9/307 160/176.1 R
5,839,494 A * 11/1998 Judkins ..... E06B 9/303 160/167 R
6,105,652 A * 8/2000 Judkins ..... E06B 9/307 160/115
6,105,655 A * 8/2000 Judkins ..... E06B 9/262 160/174 V
6,263,944 B1 * 7/2001 Judkins ..... E06B 9/262 160/168.1 R
6,279,642 B1 * 8/2001 Liu ..... E06B 9/382 160/176.1 R
6,321,820 B1 * 11/2001 Liu ..... E06B 9/303 160/177 R
6,622,770 B1 * 9/2003 Tyner ..... E06B 9/307 160/177 R
6,976,522 B2 * 12/2005 Strand ..... E06B 9/308 160/168.1 R
7,921,897 B2 * 4/2011 Chou ..... E06B 9/307 160/176.1 R
7,926,540 B2 * 4/2011 Lai ..... E06B 9/303 160/115
7,926,541 B2 * 4/2011 Chou ..... E06B 9/307 160/176.1 R
8,267,145 B2 9/2012 Fraser
8,991,469 B2 * 3/2015 Defenbaugh ..... E06B 9/303 160/176.1 R
2003/0178156 A1 9/2003 Tyner
2007/0204964 A1 * 9/2007 Damiano ..... E06B 9/307 160/177 R
2008/0083513 A1 * 4/2008 Chen ..... E06B 9/307 160/177 R
2016/0123075 A1 * 5/2016 Fraser ..... E06B 9/384 160/176.1 R

* cited by examiner

TILT MECHANISM FOR A WINDOW BLIND

This application is related to and claims priority from U.S. Provisional Application Ser. No. 62/074,688, filed Nov. 4, 2014.

BACKGROUND

The present invention relates to a tilt mechanism for a Venetian blind. More particularly, it relates to a tilt mechanism intended to minimize the torque exerted to tilt the slats of the blind from fully open to fully closed and back to fully open.

In the prior art, when the blind is in the fully open position, the forces on the front and rear tilt cords are nearly equal, and it is easy to rotate the tilt drum. However, as the slats approach the fully closed position, the forces become very imbalanced, and the torque required to rotate the tilt drum greatly increases, making it difficult to rotate the tilt drum to and from the fully closed position.

SUMMARY

This specification provides an arrangement that makes the forces on the front and rear tilt cords nearly equal for the full rotation of the tilt drum, from the fully open position to the fully closed position, and then back again to the fully open position, thereby greatly reducing the torque required to rotate the tilt drum.

The preferred embodiments tackle two of the main causes for imbalance between the front and rear tilt cords that are found in the prior art. By tackling these causes of imbalance, one embodiment has achieved a reduction of maximum torque of 65% or more.

One cause for imbalance between the front and rear tilt cables in the prior art is that, in order for the front and rear tilt cables to come close enough together to reach the fully closed position, one of the tilt cables goes slack and the other tilt cable has to carry the entire load. So, in this case, one of the tilt cables carries 100% of the load, and the other tilt cable carries none of the load. A preferred embodiment of the present invention eliminates this problem.

Another cause for imbalance between the front and rear tilt cables in the prior art is that, due to the natural geometry of a Venetian blind, the center of gravity of the slats is lowered as the blind is closed. This means that, in the process of returning the slats to the fully open position, the tilt cables have to raise the center of gravity of all the slats, which increases the torque required. A preferred embodiment of the present invention maintains the center of gravity of the slats at substantially the same elevation from the fully open position to the fully closed position in order to greatly reduce this cause of increased torque.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. It should be understood that the claimed subject matter is not necessarily limited to the particular embodiments or arrangements illustrated herein.

BRIEF DESCRIPTION OF THE DRAWINGS

The accompanying drawings are for purposes of illustration only, and the dimensions, positions, order, and relative sizes reflected in the drawings attached hereto may vary. The detailed description will be better understood in conjunction with the accompanying drawings, wherein like reference characters represent like elements, as follows.

DESCRIPTION

Figure 1:
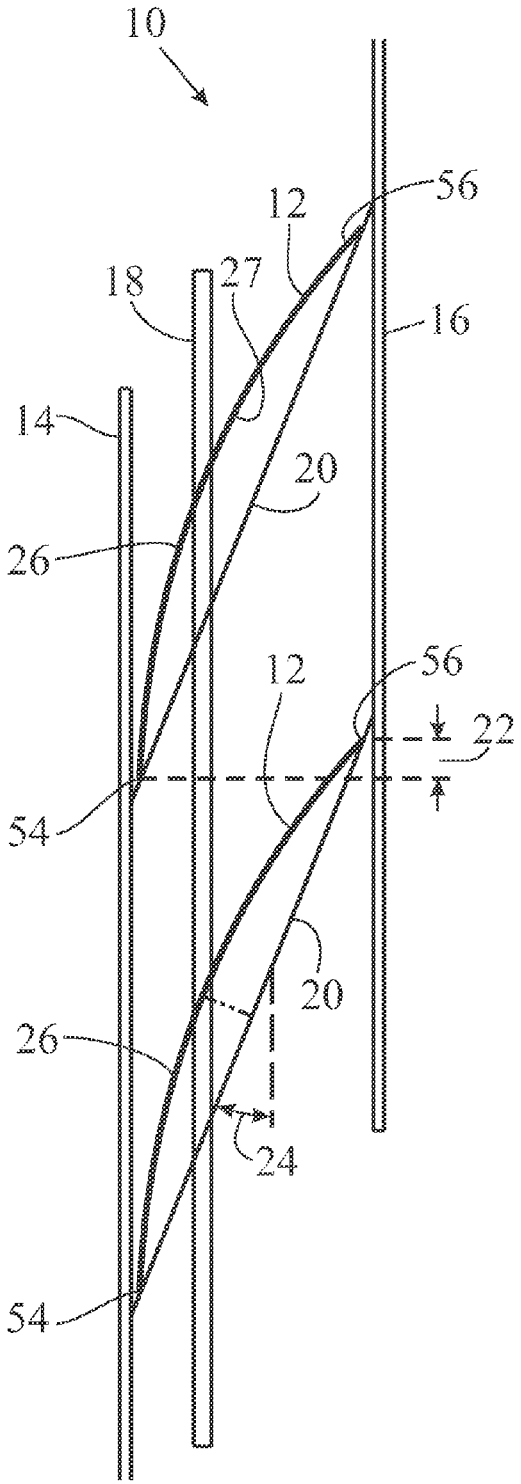
FIG 1 (Prior Art)
FIG. 1 is a broken-away, schematic end view of a prior art blind in the tilted closed position.

FIG. 1 is a view of a prior art blind 10 including two slats 12 with front and rear tilt cables 14, 16 respectively, and a lift cord 18. The tilt cables 14, 16 are part of a "ladder tape", which includes the tilt cables 14, 16 and rungs 20. Each rung 20 is attached at its front end to the front tilt cable 14 and at its rear end to the rear tilt cable 16. The front and rear tilt cables 14, 16 and plurality of parallel rungs 20 form a flexible ladder. Each slat 12 rests on one of the rungs 20 of the ladder tape between the tilt cables 14, 16. The slats 12 have an arcuate cross-sectional shape, with the convex surface or crown 26 facing upwardly and the concave surface 27 facing downwardly. In this case, we refer to the tilt cable 14 as being the front tilt cable 14 or the room-side cable 14, and to the tilt cable 16 as being the rear tilt cable 16 or the window-side cable 16. However, it will be obvious that front and rear could be reversed.

Figures 1A, 1B, 1C, 2A:
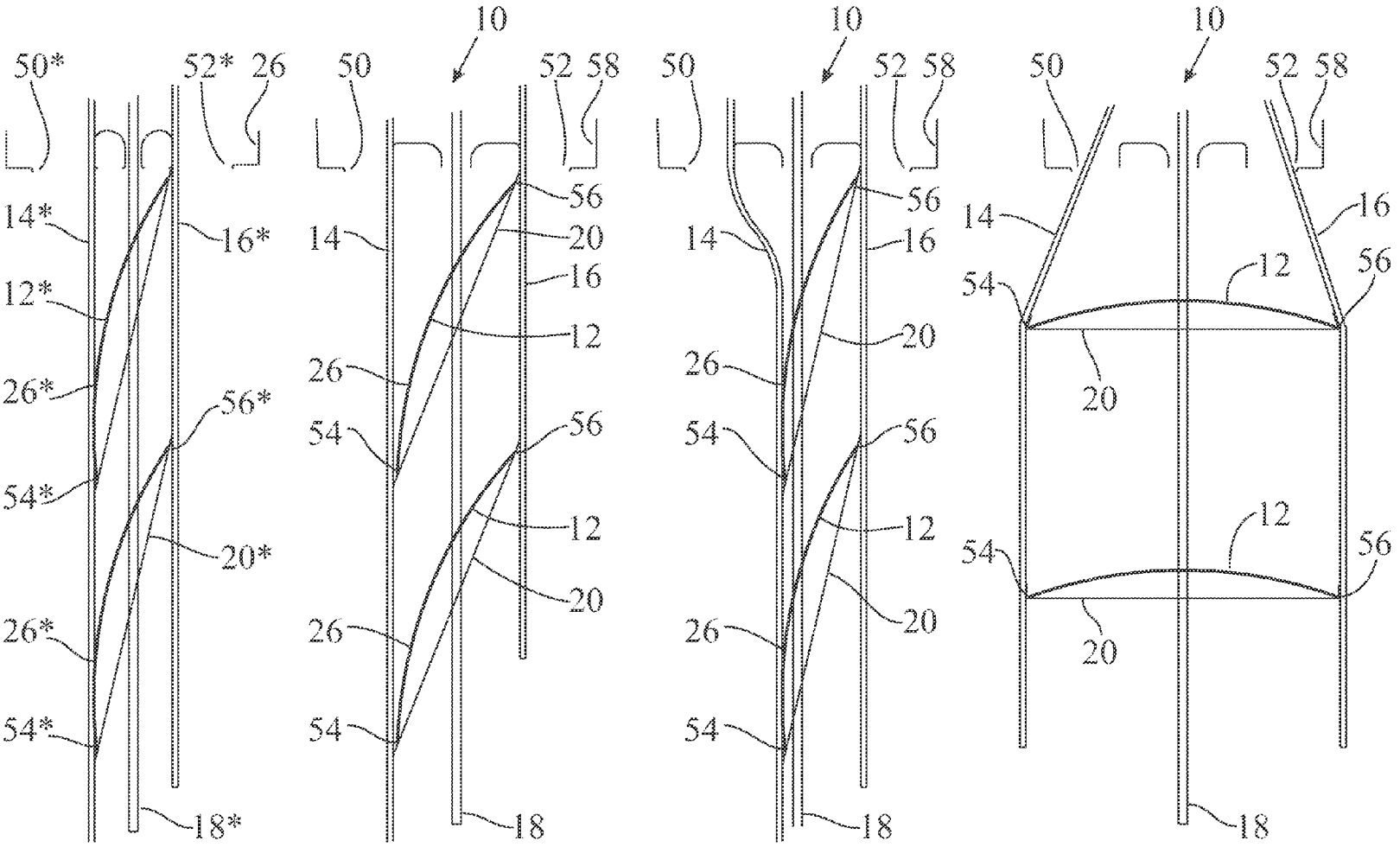
FIG 1C (Prior Art)
FIG 1B (Prior Art)
FIG 1A (Prior Art)
FIG. 1A is a broken-away, schematic end view of the prior art blind of FIG. 1 including a broken-away schematic bottom portion of the head rail showing the rout openings for the tilt cables and for the lift cord, with the slats in a partially closed position.
FIG. 1B is a broken-away, schematic end view of the blind of FIG. 1A, but with the blind tilted to the fully closed position.
FIG. 1C is the same view as FIG. 1B, but with the blind in the fully open position.
FIG. 2A is a broken-away, schematic end view of the blind of FIG. 2 including a broken-away schematic bottom portion of the head rail showing the rout openings for the tilt cables and for the lift cord.
Figures 3A, 3B, 3C, 3D, 3E, 3F, 3G:
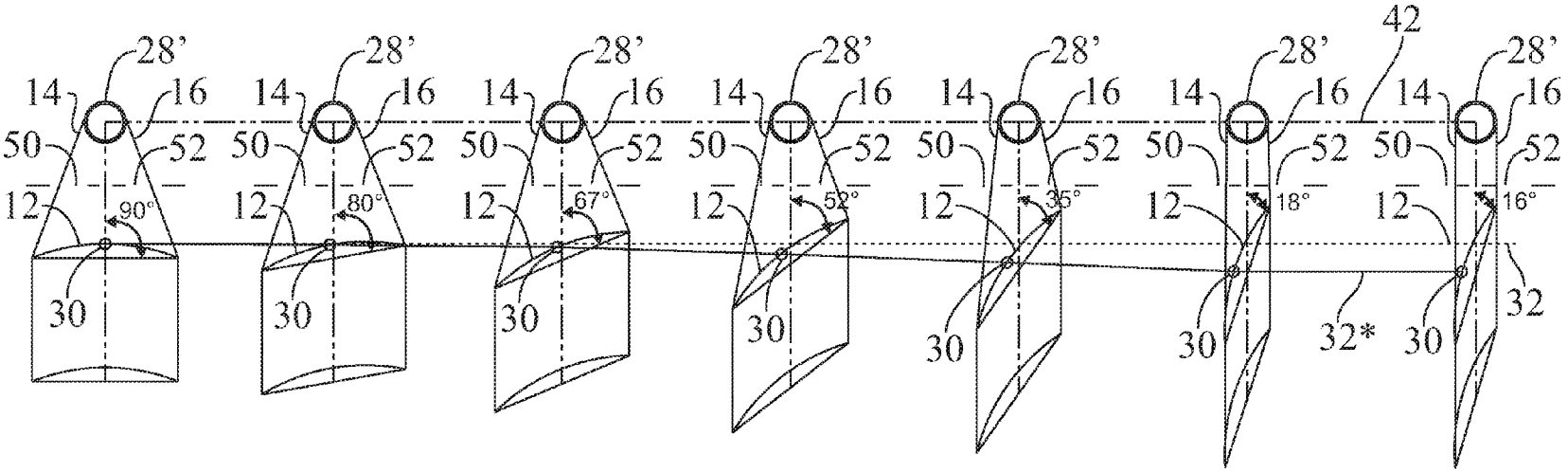
FIGS. 3*a*-3*g* are a series of schematic end views of a small diameter cylindrical tilt drum connected to a two-slat blind, showing the blind being tilted to the closed position and the resulting downward translation of the center of gravity of each slat as the slat is rotated to the tilted closed position.

In FIG. 1C, the blind 10 is fully open. In FIGS. 1 and 1A, the blind 10 is partially closed room-side-down. In FIG. 1B, the blind 10 is fully closed room side down.

Referring to FIG. 1A, the tilt cables 14, 16 extend downwardly from the head rail 58. The front tilt cable 14 extends through the front tilt-cable rout hole 50 in the head rail 58, and the rear tilt cable 16 extends through the rear tilt cable rout hole 52 in the head rail 58. The front edge 54 of each slat 12 lies adjacent to the front end of each rung 20, and the rear edge 56 of each slat 12 lies adjacent to the rear end of each rung 20.

When the slats 12 are in the fully open position, as shown in FIG. 1C, with the front and rear edges 54, 56 of each slat 12 at the same elevation, the tilt cables 14, 16 diverge outwardly as they extend from the tilt-cable rout holes 50, 52 to the ends 54, 56 of the rungs 20. This is the maximum divergence between the tilt cables 14, 16 because this is the tilt position at which the front-to-rear horizontal distance between the front and rear edges 54, 56 of the slats 12 is at a maximum. As the rear tilt cable 16 is lifted and the slats 12 begin to be tilted closed by pivoting from a horizontal position toward a more vertical position, the distance between the front and rear tilt cables 14, 16 decreases, as the front-to-rear horizontal distance between the front and rear edges 54, 56 of each slat 12 decreases.

FIG. 1A shows the position of the slats 12 when the front and rear tilt cables 14, 16 extend vertically downwardly from the rout holes 50, 52, with each respective tilt cable 14, 16 abutting the inner edge of its respective rout hole 50, 52. In this position, the horizontal distance between the front and rear tilt cables 14, 16 is equal to the minimum distance between the rout holes 50, 52 in the head rail 58.

The typical industry practice has been to use a large diameter tilt drum and to space these rout holes 50, 52 at a distance farther apart than the horizontal, front-to-rear distance of the slats 12 in the fully closed position. This means that, in order for the tilt cables 14, 16 to come close enough together for the blind to be fully closed, the cable that is going down has to go slack, which shifts all the load to the cable that is going up. This condition is shown in FIG. 1B, in which the rear tilt cable 16 is carrying the entire load, and the front tilt cable 14 is slack.

It should be noted that the position of the blind 10 in FIGS. 1 and 1A is not the fully closed position, because it is possible to pivot the slats further toward a vertical position until the crown 26 of each slat 12 abuts the front tilt cable 14, as shown in FIG. 1B.

In FIG. 1B, the slats 12 have reached the fully closed position, because raising the rear tilt cable 16 further will not cause the slats 12 to pivot to a more vertical position. It is desirable to reach the fully closed position, because this greatly reduces the amount of light that can pass through the blind.

To understand why the slats cannot pivot to a more vertical position from the position shown in FIG. 1B, consider the following: Each rung 20 extends at an upward angle from the front tilt cable 14, so the rung 20 keeps the front edge 54 of its respective slat adjacent to the front tilt cable 14 and prevents the front edge 54 of the respective slat from moving further rearwardly. Also, the crown 26 of each slat 12 is abutting the front tilt cable 14, so the front tilt cable 14 prevents the crown 26 from moving further forwardly. Since the front edge 54 and the abutment point between the crown 26 and the front tilt cable 14 are fixed for each slat 12, the slats 12 cannot pivot further toward the vertical (to a more fully closed position) no matter how much the rear tilt cable 16 is raised.

In the prior art arrangement, in order to go from the partially closed position of FIG. 1A to the fully closed position shown in FIG. 1B, the user pulls up further on the rear cable 16 until the crown 26 of each slat 12 impacts against the front tilt cable 14, as shown in FIG. 1B. At that point, the slats 12 have reached their fully closed position and cannot be made to pivot any further toward the vertical, as explained above. For the purposes of this specification, the definition of fully closed position is the position at which the slat will not rotate further toward the vertical by lifting up further on the tilt cable that is being lifted to rotate the slat toward the vertical. That may be the rear tilt cable, as shown here, or it may be the front tilt cable, if the blind is being closed room side up.

Note that the limiting factor that determines the fully closed position for this blind, having thin, arcuate slats 12 is when the crown of each slat 12 impacts against the front tilt cable (or against the rear tilt cable if front and rear are reversed).

For a blind with flat, non-arcuate slats, there is a different limiting factor that determines the fully closed position beyond which the slats will not rotate further toward the vertical. In that case, the limiting factor is the length of the lift-cord rout opening in each of the slats, as will be explained later.

As was explained earlier, in order to move from the partially closed position in FIGS. 1 and 1A to the fully closed position in FIG. 1B, the user lifts the rear tilt cable 16, which lifts the rear ends of the rungs 20 of the ladder tape. Eventually, the rear ends of the rungs 20 of the ladder tape are lifted up far enough until the front ends of the rungs 20 lift the front tilt cable 14, causing the front tilt cable 14 to become slack between the tilt drum (not shown in FIGS. 1, 1A, and 1B) and the topmost rung 20. As the front cable 14 becomes slack, it shifts inwardly from the straight vertical path of FIGS. 1 and 1A to the inwardly curved path shown in FIG. 1B. This shifting has to occur in order for the front and rear tilt cables to come close enough together to bring the slats to the fully closed position.

At this point (the fully closed position shown in FIG. 1B), the portions of the front and rear tilt cables 14, 16 below the head rail 58 are closer together than the minimum distance between the front and rear rout holes 50, 52.

Because the entire load has shifted to the rear tilt cable 16, the forces on the front and rear tilt cables 14, 16 are very unbalanced, and the amount of torque greatly increases.

During the rotation from the fully open position of FIG. 1C to the partially closed position of FIG. 1A, each of the front and rear tilt cables 14, 16 is exerting approximately 50% of the total force being exerted by both of the front and rear tilt cables 14, 16, with each cable supporting about half of the load of the slats 12 at every point from the fully open position to the partially closed position. However, when the front tilt cable 14 goes slack (See FIG. 1B), it stops carrying any of the load, and the entire load (100%) is carried by the rear tilt cable 16. This means that the torque required to rotate the tilt drum from the partially closed position of FIG. 1A to the fully closed position of FIG. 1B is greatly increased from the torque required to rotate the tilt drum from the fully open position of FIG. 1C to the partially closed position of FIG. 1A.

In order to greatly reduce the maximum torque that is needed, it is preferred that each of the front and rear tilt cables 14*, 16* exerts between 40% and 60% of the total force exerted by both the front and rear tilt cables 14*, 16* at every point throughout the entire rotation of the tilt drum from the fully open position to the fully closed position and back to the fully open position. In order to achieve that goal, this slack cord phenomenon needs to be eliminated.

Eliminating the Slack Cord Phenomenon:

FIGS. 2, 2A, and 7A-7C show an embodiment of the present invention in which the front and rear tilt cables 14*, 16* extend in a straight line from the tilt drum 27* (See FIG. 7C), through the rout holes 50*, 52*, to the front and rear edges of the top slat 12* when the blind is in the fully closed position, so the blind reaches the fully closed position without the front tilt cable 14* going slack and without the rear tilt cable 16* having to lift the front tilt cable 14* and the full weight of all the slats 12*. This means that the front and rear tilt cables 14*, 16* carry the load of the slats more evenly all the way to the fully closed position than in the prior art arrangement of FIGS. 1-1C. This greatly reduces the maximum torque that is needed to reach full closure of the blind.

This blind 10* has slats 12*, front and rear tilt cables 14*, 16*, rungs 20*, and a lift cord 18*. In this case, as shown in FIG. 2A, the tilt-cable rout holes 50*, 52* in the head rail 58 are closer together than in the prior art blind 10 of FIG. 1A. In this embodiment, the minimum spacing between the tilt-cable rout holes 50*, 52* is small enough, and the front and rear tilt cables 14*, 16* leave the tilt drum 28* at points that are close enough together, that the blind 10* reaches the fully closed position, with the crown 26* of each slat 12* contacting the front tilt cable 14*, when the front and rear tilt cables 14*, 16* extend in a straight line from the tilt drum 28*, out through the rout holes 50*, 52*, to the front and rear ends of the top rung 28*. Since full closure is reached without the rear tilt cable 16* having to lift the front cable 14* and the full weight of all the slats 12*, the amount of torque required to reach full closure is greatly reduced from the prior art arrangement described above.

In order to reach full closure without the rear tilt cable 16* having to lift the front tilt cable 14* and the full weight of all the slats 12*, the minimum distance between the front and rear rout holes 50*, 52* through which the front and rear tilt cables 14*, 16* extend, should be no greater than the horizontal distance between the front and rear edges 54*, 56* of the slats 12* when the blind 10* is in the fully closed position. Also, the front and rear tilt cables 14*, 16* should leave the tilt drum 28* at points that are no farther apart than the horizontal distance between the front and rear edges 54*, 56* of the slats 12* when the blind 10* is in the fully closed position.

For example, in a blind 10*, with 2 inch wide slats 12* and a standard curvature of the slats 12*, the minimum distance between the front and rear rout holes 50*, 52* in the head rail 58* (which is the distance between the front and rear tilt cables 14*, 16* in FIG. 2A), and the maximum distance between the points at which the front and rear tilt cables 14*, 16* leave the tilt drum 28* in the fully closed position, should not exceed 0.48". When the front and rear tilt cables 14*, 16* leave the tilt drum 28* from points that are spaced apart a distance of 0.48" and extend straight vertically downwardly through the rout holes 50*, 52* at a spaced-apart distance of 0.48" when the blind is in the fully closed position, there is a 0.215" overlap 22* (See FIG. 2) and a 13 degree slat angle 24*, with the front tilt cable 14* abutting the crowns 26* of each of the slats 12*. This is the fully closed position, because lifting up further on the rear tilt cable 16* will not cause the slats 12* to pivot to a more vertical position, as explained earlier with respect to FIG. 1B.

FIG. 4 and FIGS. 7A-C show a tilt drum 28* which supports the front and rear tilt cables 14*, 16* and which is rotated to raise the rear tilt cable 16* and lower the front tilt cable 14* to close the blind 10*. In this preferred embodiment, the tilt drum 28* is oblong in order to provide the distance between the departure points in the fully closed position as described above while still providing enough take-up and playing out of the tilt cables 14*, 16* to go from a fully open position to a fully closed position with less than 360 degrees of rotation. (In this particular embodiment, the drum rotates 180 degrees to go from a fully open to a fully closed position.) It is desirable to go from fully open to fully closed with 360 degrees of rotation or less in order to avoid overwrap and possible tangling of the tilt cables.

When the blind is in the fully closed position, the front-to-rear horizontal distance between the departure points on the tilt drum 28* from which the front and rear tilt cables 14*, 16* depart from the tilt drum 28* and extend downwardly (See FIGS. 4*g* and 7C) is not greater than the front-to-rear horizontal distance between the front and rear edges of each slat in the fully closed position. This means that the front and rear tilt cables 14*, 16* extend in a straight line from the front and rear departure points 27A, 27B of the tilt drum 28*, through the rout holes 50*, 52* at the bottom of the head rail, to the top rung at the front and rear edges 54*, 56* of the top slat 12*, without being deflected by the head rail and without either of the tilt cables 14*, 16* going slack. (If the departure points from the tilt drum 28* were farther apart than the front-to-rear horizontal distance between the front and rear edges of each slat in the fully closed position, or if the rout holes 50*, 52* were to deflect the tilt cables outwardly to a position in which the tilt cables were farther apart than that distance, then it would be necessary to lift the rising tilt cable until the lowering tilt cable went slack, as in the prior art, in order to reach full closure of the blind.)

It should be noted that the embodiment of the tilt drum 28* shown in FIGS. 4*a-g* and 7A-C is eccentric, with the axis of rotation not being at the geometric center or centroid of the tilt drum 28*. The purpose of this eccentric arrangement will be explained later. It also should be noted that in this particular embodiment, the tilt drum 28* is symmetrical, so a mirror image result is obtained when the blind is tilted closed room side down, by rotating the tilt drum in a first direction which raises the rear tilt cable 16* and lowers the front tilt cable 14*, from when the blind is closed room side up, by rotating the tilt drum 28* in the opposite direction, which raises the front tilt cable 14* and lowers the rear tilt cable 16*

Maintaining a Constant Center of Gravity:

In the prior art, the tilt drum diameter was made as large as possible in order to prevent a noticeable drop in the Center of Gravity (CoG) of each of the slats due to the geometry of the slats and the geometry of the rungs supporting the slats as the blind is being closed, in order to make it easier to open the slats, as discussed in more detail below. However, as described above, a large diameter tilt drum creates a slack cord problem.

If a circular cross-section drum were used, which had a diameter not greater than the front-to-rear horizontal distance between the front and rear edge of each slat in the fully closed position, in order to avoid the slack cord problem described above, the diameter of the drum 28* would have to be relatively small. A small diameter circular cross-section drum would cause a substantial drop in the center of gravity of the slats when moving from the fully open position to the fully closed position as explained below.

FIGS. 3*a*-3*g* and FIGS. 9 and 10 show such a small diameter circular cross-section tilt drum 28', which rotates about an axis located at the geometric center or centroid of the circle. The diameter of this drum 28' is small enough that the front and rear tilt cables 14, 16 extend in a straight line from the drum 28' to the front and rear edges of the slats 12 when the blind is in the fully closed position. It can be seen in these figures that, as the drum 28' rotates from the fully open position to the fully closed position, the center of gravity of the slat 12 drops noticeably.

Figure 9:
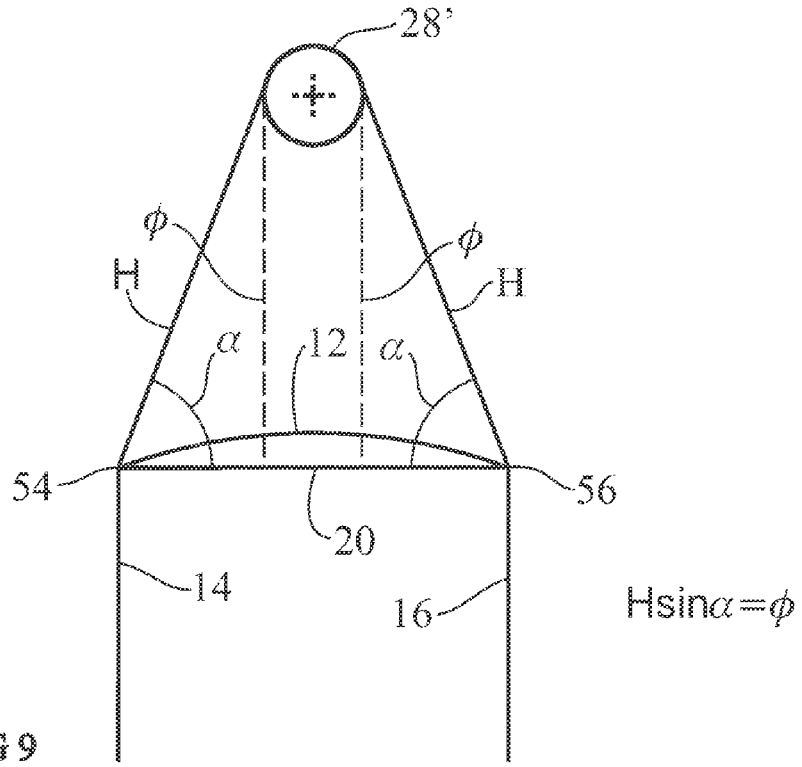
FIG. 9 is a schematic view showing a circular cross-section drum with a blind in the fully open position.
Figure 10:
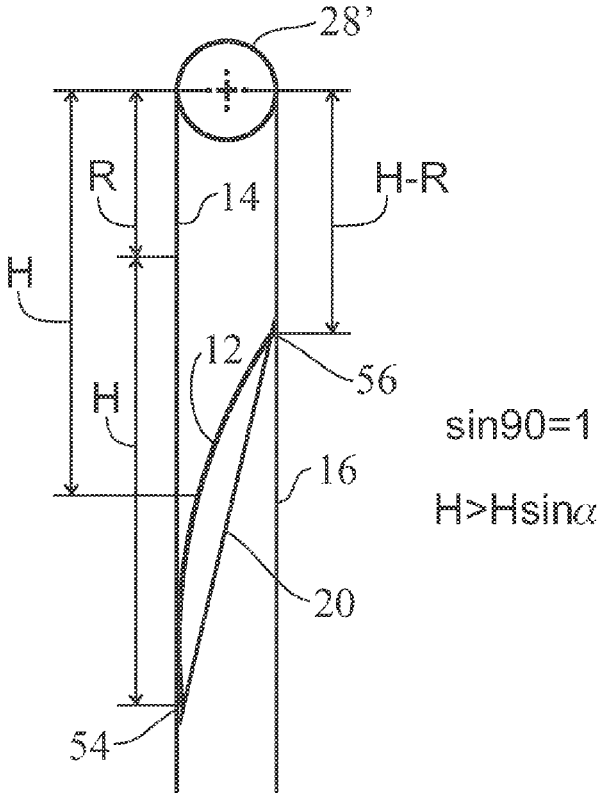
FIG. 10 is the same view as FIG. 9 but with the blind in the fully closed position.

This dropping of the center of gravity can be explained by referring to FIGS. 9 and 10.

In FIG. 9, the slat 12 is in the fully open position, with the front edge 54 and rear edge 56 of the slat 12 at the same elevation. The front tilt cable 14 extends a distance H from the front edge 54 of the slat 12 to its point of departure from the tilt drum 28' (which is at the same elevation as the point of departure of the rear tilt cable 16). The rear tilt cable 16 extends a distance H from the rear edge 56 of the slat 12 to its point of departure from the tilt drum 28'. An imaginary vertical line $\phi$ extends from the point of departure of the front tilt cable 14 (approximately at the height of the axis of rotation of the drum), down to the rung 20. This creates an imaginary right triangle with a vertical leg $\phi$, a horizontal leg (the portion of the rung 20 from the front end 54 of the slat to the bottom of the vertical line $\phi$), and a hypotenuse H. Similarly, an imaginary vertical line $\phi$ extends from the departure point of the rear tilt cable 16 (approximately at the height of the axis of rotation of the drum) to the rung 20. This creates another imaginary right triangle with a vertical leg $\phi$, a horizontal leg (the portion of the rung from the rear end 56 of the slat 12 to the vertical line $\phi$), and a hypotenuse H. We know that the hypotenuse H is longer than either of the legs of the right triangle, so H is greater than $\phi$. The ratio of the length of the leg $\phi$ to the length of the hypotenuse H is the sine of the angle $\alpha$.

FIG. 10 shows the drum 28' rotated counterclockwise from the position of FIG. 9 to the fully closed position. At this point, the front cable 14 has moved down a distance R, and the rear tilt cable 16 has moved up the same distance R, so now the vertical distance of the front tilt cable 14 from the point of departure to the front edge 54 of the slat 12 is (H+R), and the vertical distance from the point of departure of the rear tilt cable 16 to the rear edge 56 of the slat 12 is (H−R). The vertical distance from the heights of the points of departure to the center of gravity of the slat 12 and to the center of the rung 20 is the average of those two distances, which is H. Since the length of H is greater than the length of $\phi$, the center of gravity of the slat 12 has dropped by an amount equal to H−$\phi$.

When the diameter of the tilt drum is large in relation to the width of the slat, there is not much difference between H and $\phi$, so the center of gravity does not drop very much. However, as the diameter of the tilt drum becomes smaller in relation to the width of the slat, the difference between H and $\phi$ increases, so the dropping of the center of gravity becomes an issue in the amount of torque required to rotate the tilt drum from the fully open position to the fully closed position and back again to the fully open position.

The dropping of the center of gravity as the tilt drum rotates is shown in FIGS. 3*a*-*g*. A first imaginary horizontal line 42 in FIGS. 3*a*-*g* extends between the axes of rotation of the cylindrical tilt drums 28'. A second imaginary horizontal line 32 extends rightwardly from the center of gravity of the top slat 12 in FIG. 3*a*. An imaginary curve 32* extends between the centers of gravity of the top slats 12 in FIGS. 3*a*-*g* to show that the center of gravity of the slats 12 moves downwardly as the slats 12 pivot from the fully open position of FIG. 3*a* to the fully closed position of FIG. 3*g*.

As the cylindrical tilt drum 28' is rotated about its axis to tilt the blind 10 from the fully open position (FIG. 3*a*) to the fully closed position (FIG. 3*g*), the center of gravity 30 of the top slat 12 (and of all the other slats 12) shifts downwardly, away from its starting reference elevation (represented by the dotted line 32) to a progressively lower elevation (represented by the solid line 32*). This downward shift of the Center of Gravity 30 causes the slats 12 to have a natural tendency to "slam" closed.

Not only is the slamming a problem, but also, in order to tilt the slats 12 back to the open position (FIG. 3*a*) from the fully closed position (FIG. 3*g*), the user must exert enough lifting force on the tilt cables 14, 16 to lift all the slats 12 in the blind 10 until the Center of Gravity 30 of each slat 12 is back up to its original reference elevation 32. This creates an increase in torque, as explained earlier.

As was explained above, the tilt drum 28* of FIGS. 4*a*-*g* and 7A-7C is oblong in order to provide the desired small distance between the departure points of the front and rear tilt cables 14*, 16* when the blind is in the fully closed position, in order to prevent the slack cord problem, while still providing enough take-up of the cord to go from the fully open position to the fully closed position in 360 degrees or less of rotation of the tilt drum.

In addition to making the tilt drum oblong, the tilt drum 28* has an axis of rotation 42 that is offset from the centroid 43 of the cross section of the drum in order to keep the center of gravity of each slat 12 nearly constant throughout the complete rotation of the tilt drum from the fully open position to the fully closed position and back to the fully open position.

The departure points 27A, 27B from which the front and rear tilt cables 14*, 16* leave the tilt drum 28* when the blind is in the fully closed position are spaced apart a horizontal distance that is no greater than, and preferably close to equal to, the front-to-rear horizontal distance between the front and rear edges of each slat when the blind is in the fully closed position, so that the front and rear tilt cables 14*, 16* extend in a straight line from the tilt drum 28*, through the rout holes 50*, 52*, to the front and rear edges 54*, 56*, respectively, of the top slat 12* (and to the front and rear ends of the top rung 20*) when the blind is in the fully closed position, without either tilt cable 14*, 16* being deflected by the head rail or going slack.

In order to keep the center of gravity of the slats constant, the axis of rotation 42 of the tilt drum 28* is offset from the centroid 43 of the cross section of the tilt drum by a distance d.

Figure 7A:
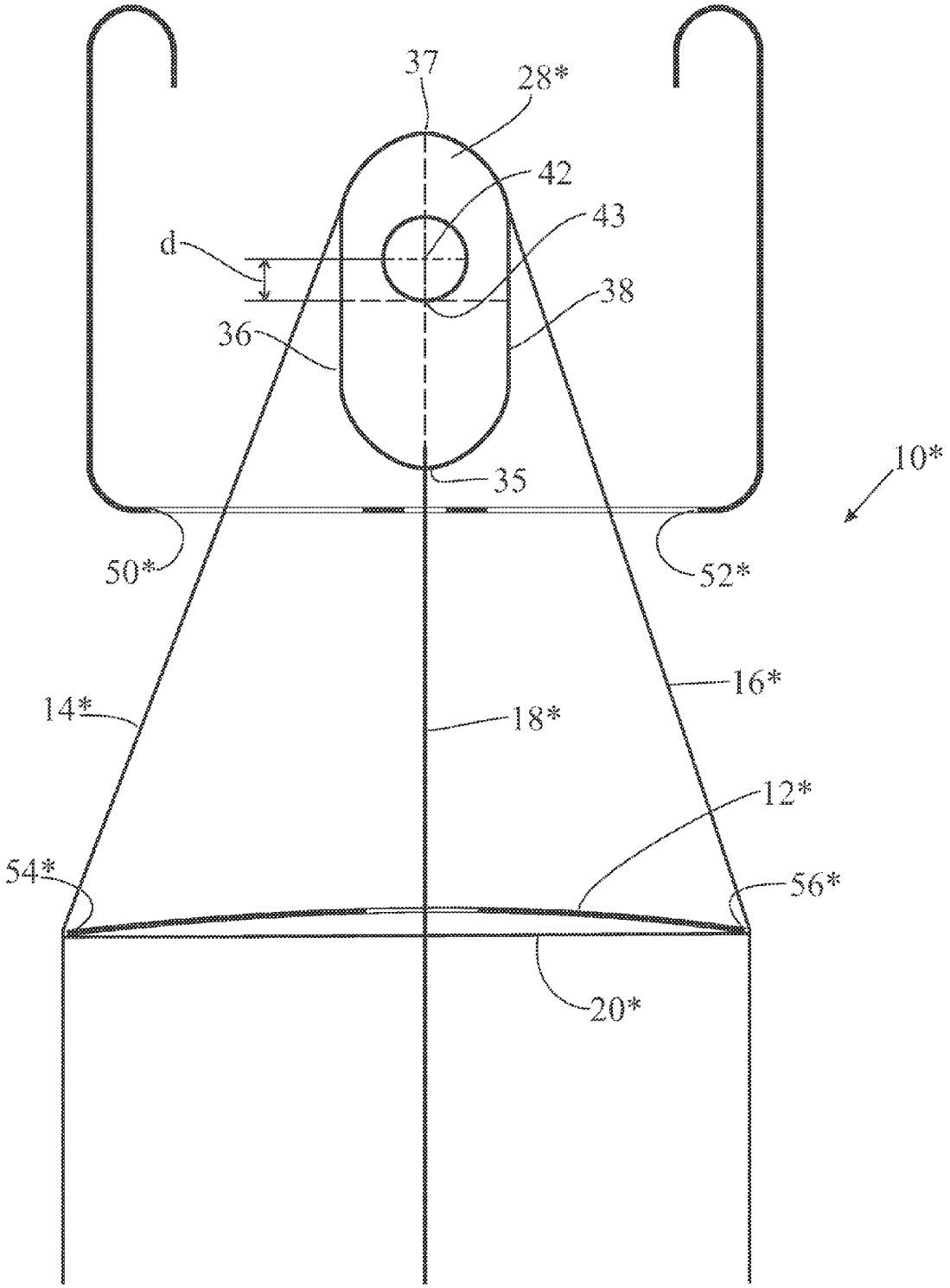
FIG. 7A is a section view of the blind of FIG. 4*a*, showing also the head rail and the rout openings for the tilt cables and for the lift cord.

The axis of rotation 42 is a distance d above the centroid 43 of the cross section of the tilt drum 28* when the drum 28* is in the fully open position shown in FIG. 7A. When the tilt drum 28* is in the fully closed position shown in FIG. 7C, the axis of rotation 42 of the tilt drum 28* is a distance d below the centroid 43. This arrangement ensures that the lift cable that is being raised to rotate the slats to the closed position travels a greater distance than the lift cable that is being lowered.

Figure 7B:
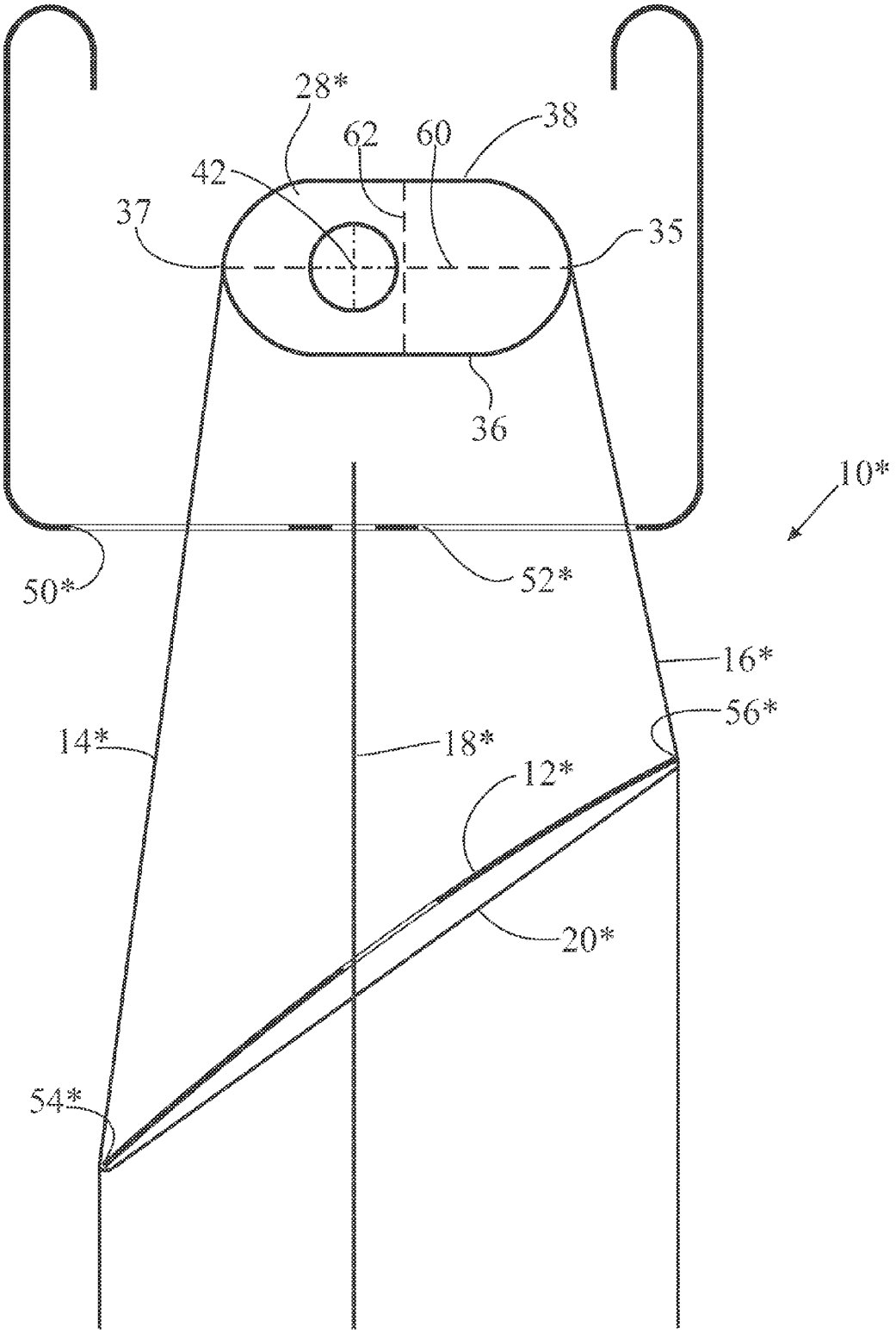
FIG. 7B is a section view, similar to FIG. 7A, but showing when the tilt drum has been rotated 90 degrees counter-clockwise.
Figure 7C:
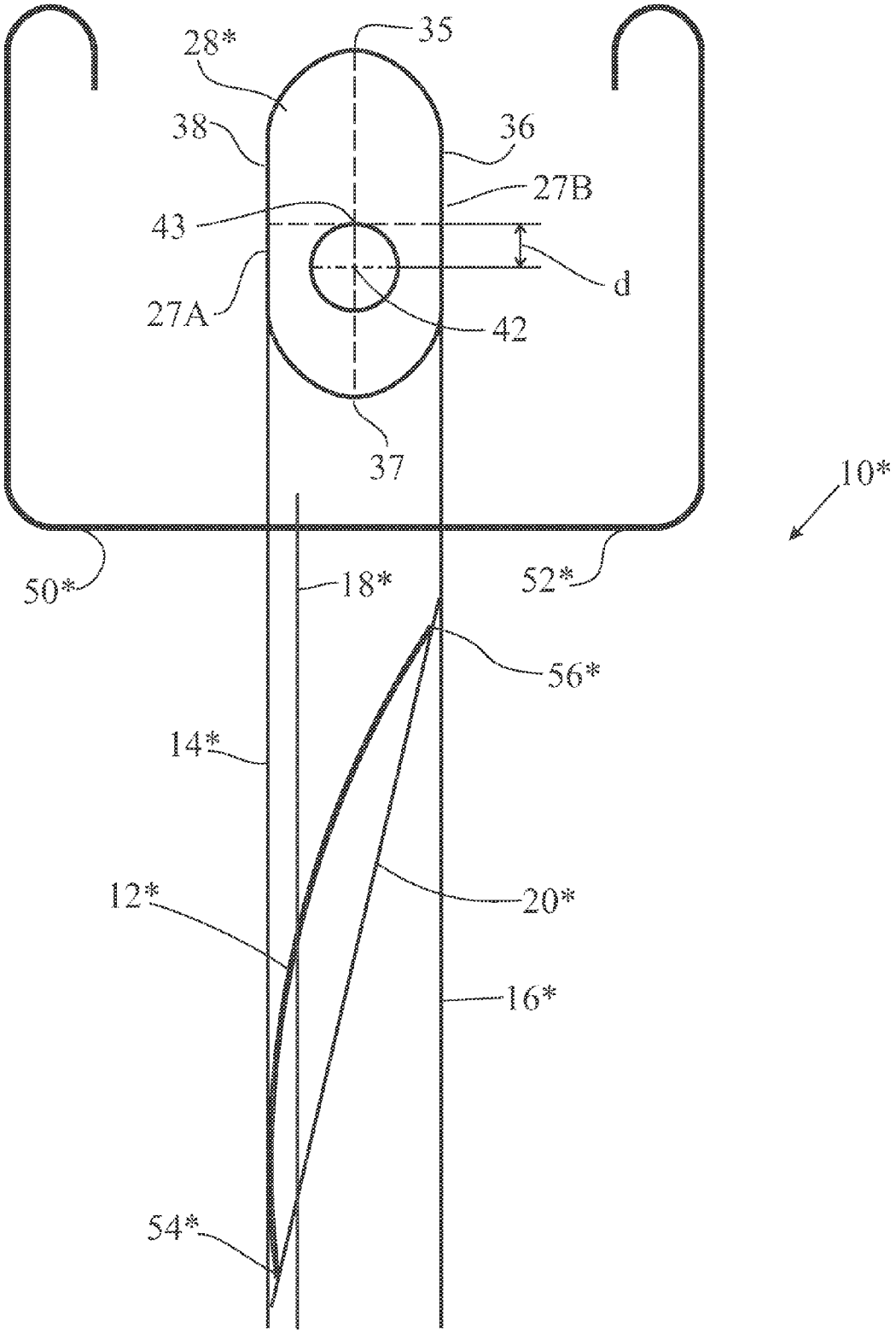
FIG. 7C is a section view, similar to FIG. 7A, but showing when the tilt drum has been rotated 180 degrees counter-clockwise to achieve full closure of the blind.

In this embodiment, shown in FIGS. 7A-7C, the tilt drum 28* rotates 180 degrees from the fully open position to the fully closed position. Thus, when the tilt drum 28* of FIG. 7A is being rotated counterclockwise to raise the rear tilt cable 16* to close the blind, the rear tilt cable 16* travels the distance travelled by the front tilt cable 14* plus 2 d. In order to keep the center of gravity of the slats constant in this embodiment, the offset distance d preferably is one-half of distance the center of gravity would have dropped if the center of rotation 42 were at the centroid 43.

If the symmetrical nature of the drum were changed, then the distance d could change.

Since the tilt drum 28* of this embodiment is symmetrical, the center of gravity of the slats is also maintained at a constant level if the blind is closed by rotating the tilt drum clockwise from the position of 7A in order to close the blind by raising the front tilt cable 14* and lowering the rear tilt cable 16*.

Figure 6:
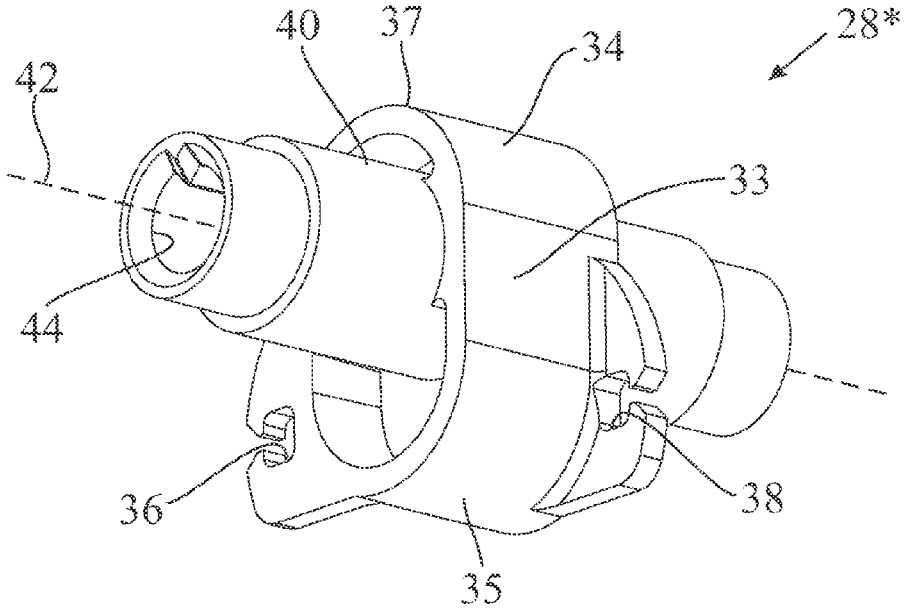
FIG. 6 is a perspective view of the tilt drum of FIG. 5 but with the cable-guiding flanges omitted for clarity.

FIG. 6 is a perspective view of the eccentric, oblong tilt drum 28*. The tilt drum 28* includes a member 33 which defines a surface 34 having an oblong cross-section with an elongated direction and defining first and second ends 35, 37 that are opposite each other in the elongated direction. Referring briefly to FIG. 7B, the elongated direction of the tilt drum 28* will be referred to as the major axis 60 of the tilt drum 28*, and the other axis, which is perpendicular to the major axis 60, will be referred to as the minor axis 62 of the tilt drum 28*. Where those two axes 60, 62 intersect is the geometric center or centroid of the cross-section of the drum 28*. Two tilt-cable-anchor points 36, 38 (See FIG. 6) lie adjacent to the first end 35. A shaft 40 is eccentrically mounted to the member 33, having an axis of rotation 42 that is offset from the geometric center or centroid of the oblong cross-section of the surface 34 toward the second end 37. This puts the axis of rotation 42 offset above the centroid of the drum 28* when the blind is in the fully open position of FIG. 7A. The member 33 is mounted for rotation with the shaft 40 about the axis of rotation 42. The shaft 40 of the exemplary embodiment of the Figures is hollow and defines a non-circular internal cross-sectional profile 44 designed to engage a tilt rod (not shown) which, in this embodiment, is manually driven by the user for rotation about the axis of rotation 42, such as by using a tilt wand or a tilt cord (not shown), which are well-known in the art. (The tilt rod could alternatively be driven by a motor, if desired, as known to those of ordinary skill in the art.)

Figure 5:
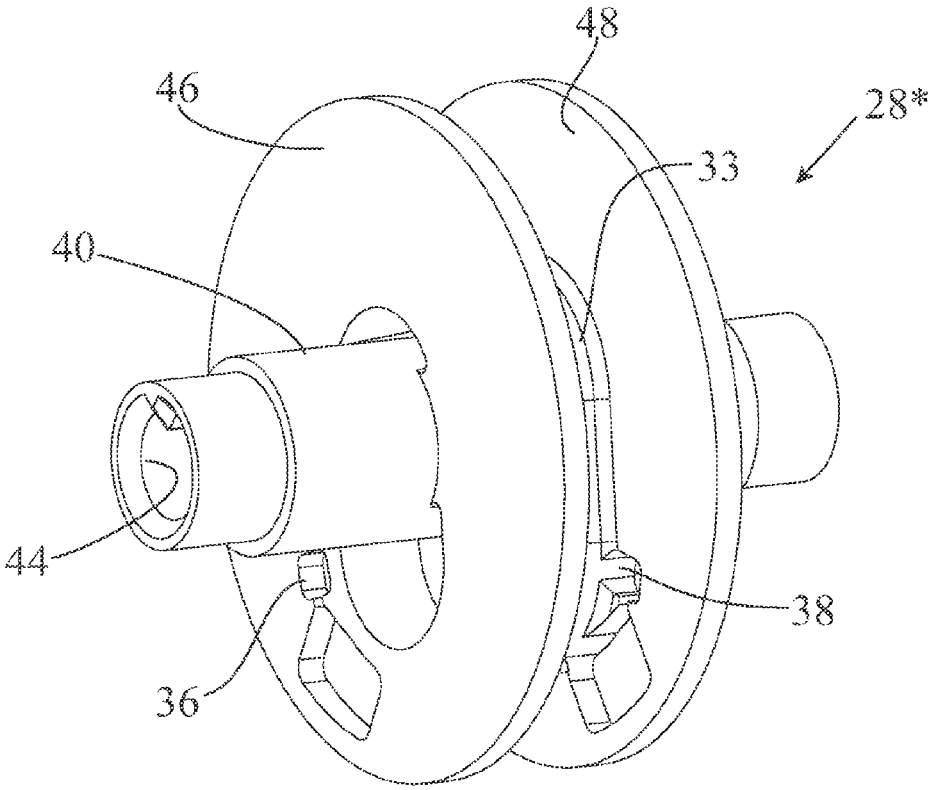
FIG. 5 is a perspective view of the tilt drum of FIGS. 4*a*-4*g;*

FIG. 5 shows two flanges 46, 48 at the front and rear edges of the member 33 and having radii larger than the radial dimension to the two anchor points 36, 38. These flanges 46, 48 guide the tilt cables 14*, 16*, to prevent the tilt cables 14*, 16* from falling off the oblong surface 34 as they wrap onto and off of the drum 28*.

Figures 4A, 4B, 4C, 4D, 4E, 4F, 4G:
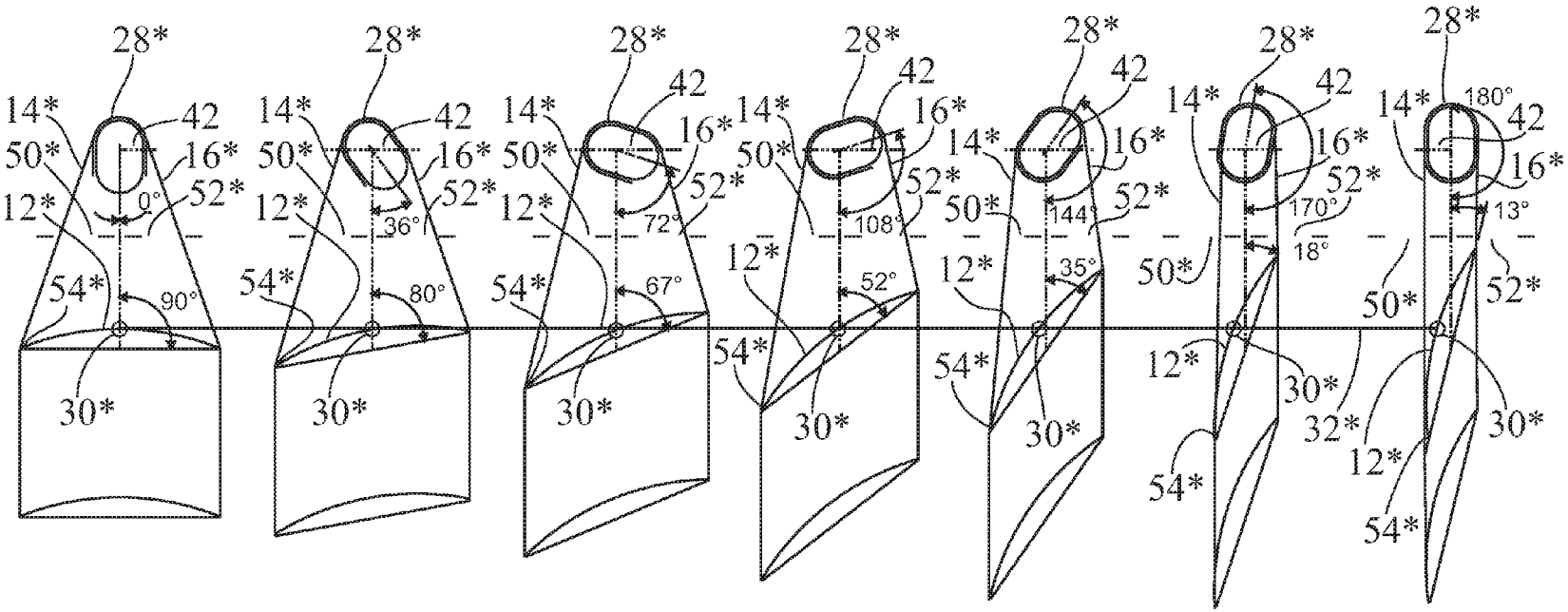
FIGS. 4*a*-4*g* are a series of end views, similar to those of FIG. 3*a*-3*g*, but for a non-circular cross-section tilt drum with an axis of rotation offset from the centroid of the drum, showing that, as the slats are tilted to the closed position, the center of gravity of each slat remains at the same elevation regardless of the degree of rotation of the slat.

The orientation of the drum 28* when the blind 10* is in the fully open position shown in FIGS. 4*a* and 7A is with the two tilt-cable-anchor points 36, 38 below the axis of rotation 42, as shown in FIGS. 5 and 6. The front tilt cable 14* is routed through its corresponding tilt-cable rout opening 50* in the head rail, up and over the drum 28*, and is attached to the rear side tilt-cable-anchor point 38 (See FIGS. 6 and 7A). The rear tilt cable 16* is routed through its corresponding tilt-cable rout opening 52* in the head rail, up and over the drum 28*, and is attached to the front side tilt-cable-anchor point 36.

Figure 2:
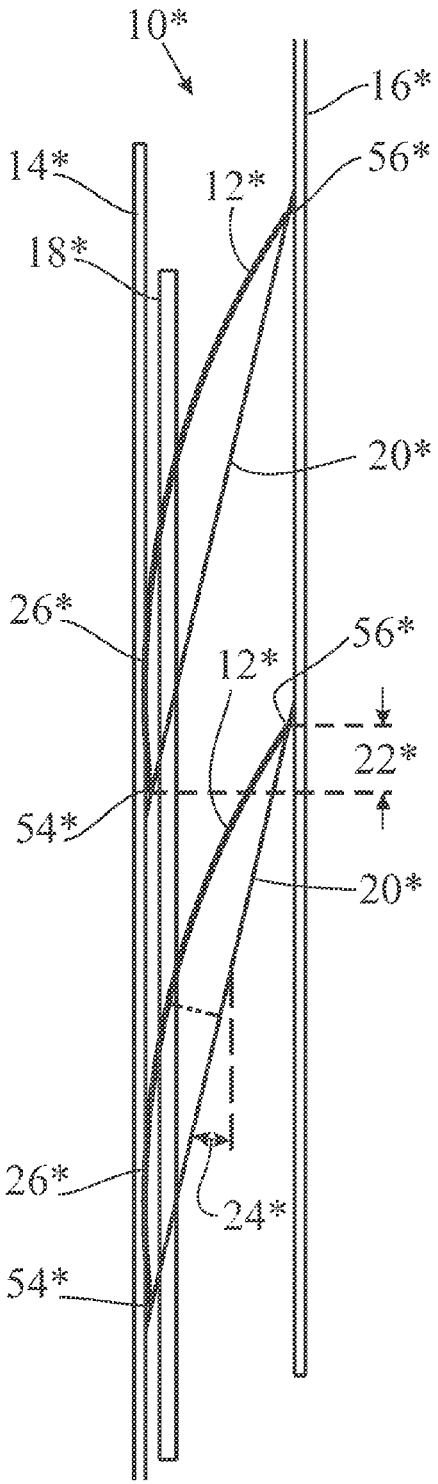
FIG. 2 is a broken-away, schematic end view, similar to that of FIG. 1, but showing one embodiment of the present invention, with the blind tilted to the fully closed position.

Referring back to FIGS. 4*a*-4*g* (See also FIGS. 7A-7C), as the drum 28* is rotated counterclockwise, the front tilt cable 14* unwinds from the drum 28*, lowering the front edge 54* of each of the slats 12* (See FIGS. 2 and 2A). At the same time, the rear tilt cable 16* winds up onto the drum 28*, raising the rear edge 56* of each of the slats 12*. The oblong shape of the surface 34, combined with the eccentric mounting of the shaft 40 relative to the member 33 of the drum 28*, results in the rear tilt cable 16* being raised faster than the front tilt cable 14* is lowered. As a result of this geometry, the Center of Gravity 30* of the slats 12* remains at substantially the same reference elevation 32* as the slats are tilted closed, as opposed to dropping as in the blind shown in FIGS. 3*a*-3*g*.

This means that less torque is required to tilt the blind 10* open from the closed position, because the Center of Gravity 30* of the slats 12* does not have to be raised in order to open the blind 10*, thereby resulting in a significant reduction in the torque required to open the blind 10*. This permits the manufacturer to use a tilt drum 28* with a smaller minor axis 62 (See FIG. 7B), so that, when the blind is in the fully closed position, the front and rear tilt cables 14*, 16* leave the tilt drum 28* from front and rear points that are spaced apart by a front-to-rear horizontal distance that is nearly equal to the front-to-rear horizontal distance between the front and rear edges of each slat so that the front and rear tilt cables 14*, 16* hang nearly vertically and extend in a straight line from the drum 28*, through the rout holes 50*, 52*, to the front and rear edges of the slats 12*.

The combination of the oblong shape of the tilt drum 28* and its eccentric mounting provide the desired conditions, keeping the center of gravity of the slats constant from the fully open position to the fully closed position, and preventing a slack cable condition.

Figure 8A:
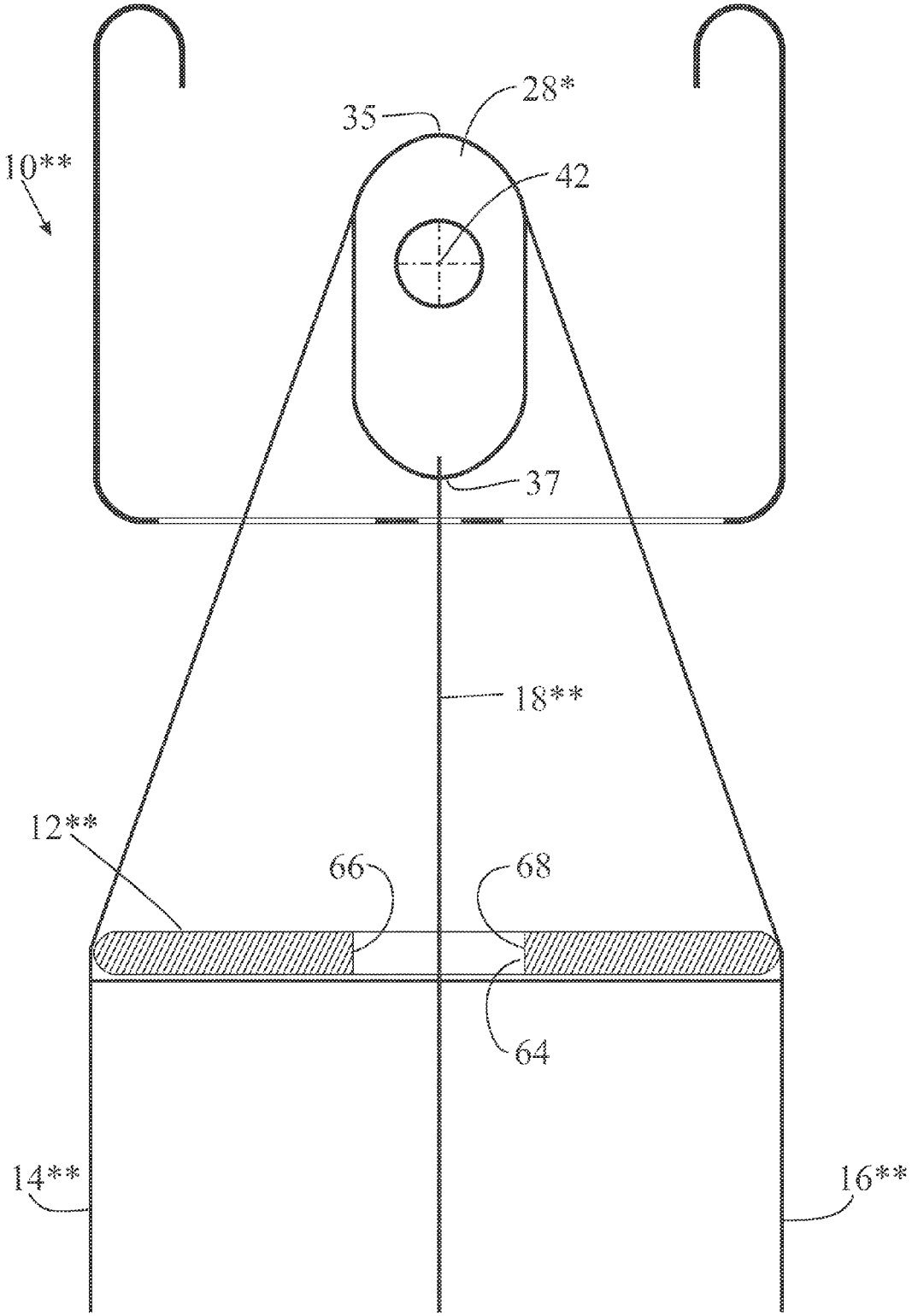
FIG. 8A is a schematic section view of a blind similar to that of FIG. 7A, but for a blind with solid, flat, rectangular slats (only one slat shown) instead of thin, arcuate slats.
Figure 8B:
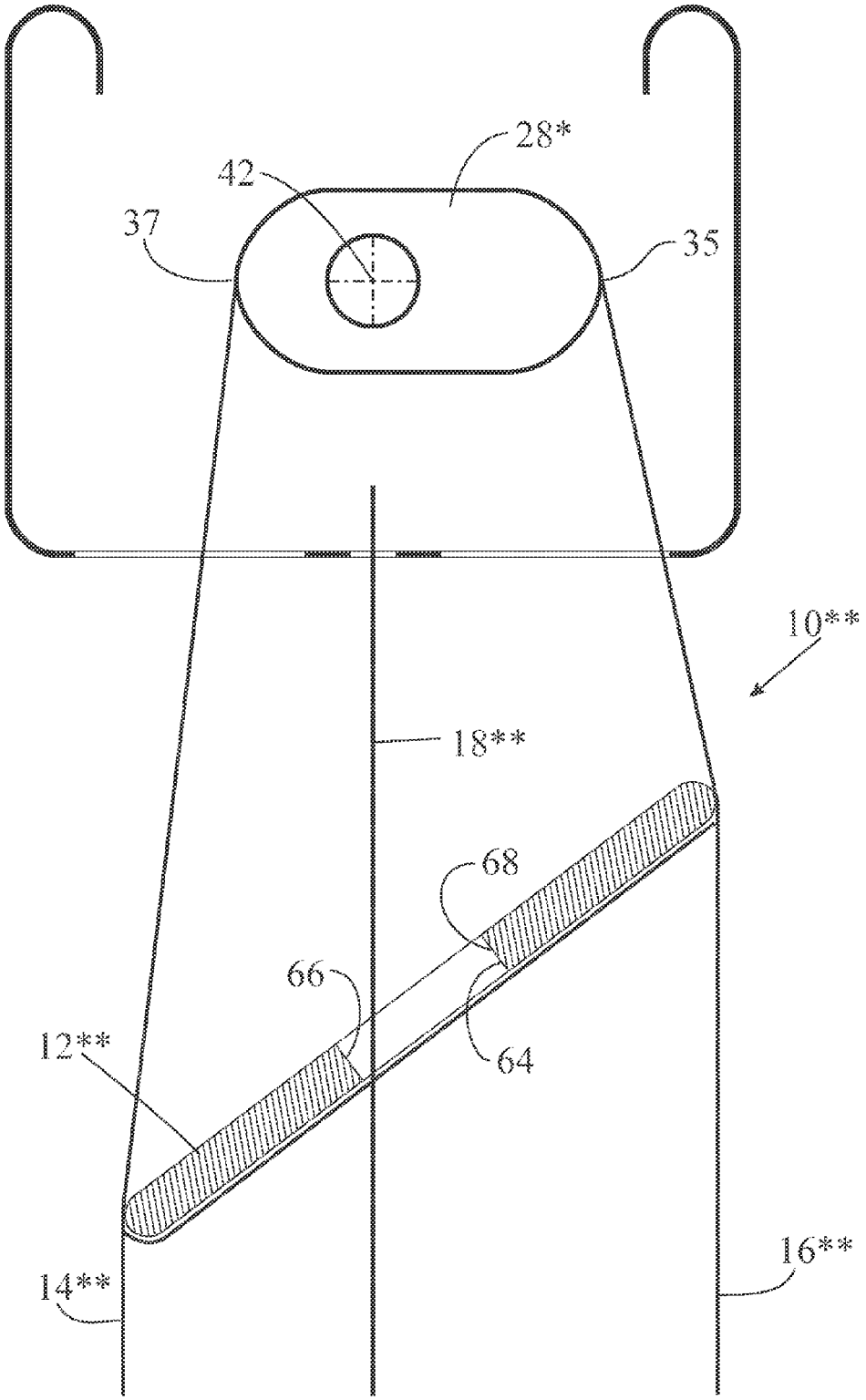
FIG. 8B is a section view, similar to FIG. 8A, but showing when the tilt drum has been rotated 90 degrees counter-clockwise.
Figure 8C:
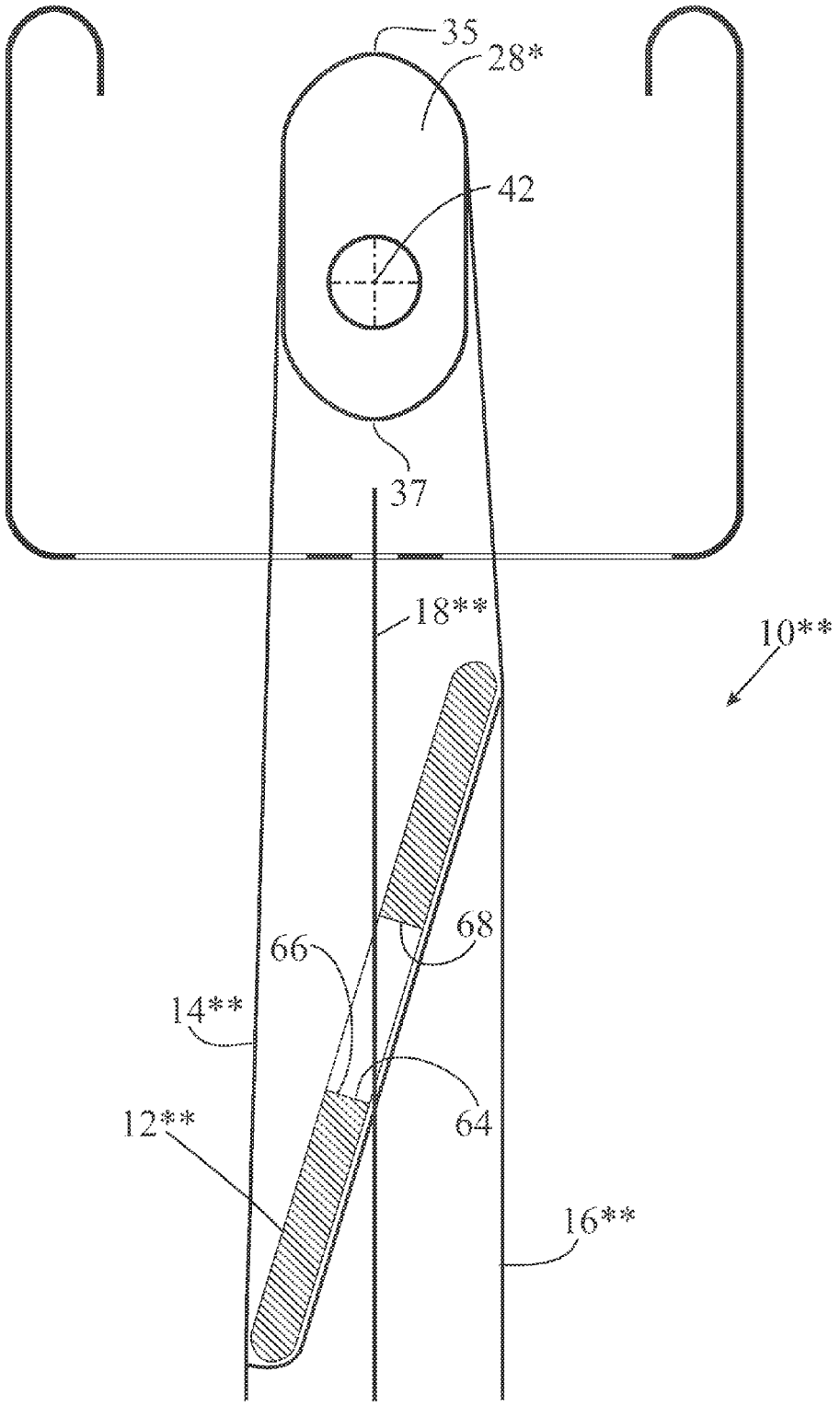
FIG. 8C is a section view, similar to FIG. 8A, but showing when the tilt drum has been rotated 180 degrees counter-clockwise to achieve full closure of the blind.

Referring now to FIGS. 8A-8C, the blind 10 is similar to the blind 10* of FIGS. 7A-7C, except that the slats 12** are flat, rectangular slats with each slat 12** having a substantial thickness. In this instance, the slats 12** have no concave side, no convex side, and there is no crown (like the crown 26* of the slat 12* of FIG. 2). Each slat 12** defines an elongated lift-cord rout opening 64 having a front end 66 and a rear end 68. The lift cord 18** extends through the lift-cord rout opening 64 of each slat 12****.

As best appreciated in FIG. 8C, as the slat 12 is tilted to the fully closed position, by lifting the rear tilt cable 16**, the lift cord 18** impacts against the rear end 68 of the lift-cord rout opening 64 and against the front end 66 of the lift-cord rout opening 64. Once the rear tilt cable 16** abuts the front and rear ends 66, 68 of the lift-cord rout opening 64, raising the rear lift cable 16** further will not result in further closure of the slats 12****. So, that position is the fully closed position for this type of blind.

The same desired conditions apply to this type of blind as to the previous type with thin, arcuate slats. The minimum distance between the rout holes should not be greater than the front-to-rear horizontal distance between the front and rear edges of the slats 12 when the blind is in the fully closed position. The front and rear points from which the front and rear tilt cables 14**, 16** leave the tilt drum when the blind is in the fully closed position should be no greater than and preferably nearly equal to the front-to-rear horizontal distance between the front and rear edges of the slats 12** so the front and rear tilt cables 14**, 16** can extend in a straight line from the tilt drum, through the rout holes, to the front and rear edges of the slats 12** without either tilt cable 14**, 16** having to lift the other tilt cable 14**, 16 (i.e. without either tilt cable 14, 16 becoming slack) in order to bring the blind to the fully closed position.

It will be obvious to those skilled in the art that modifications may be made to the embodiments described above without departing from the scope of the present invention as claimed. For example, the head rail could be installed in an inverted position so that the bottom of the head rail provides a single, large opening, in which case no rout holes would be needed in the head rail for the front and rear tilt cables or the lift cords.

In the foregoing description, it will be appreciated that the phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and/or serve to distinguish regions of the associated elements from one another, and do not limit the associated element, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

While the foregoing description and drawings represent exemplary embodiments of the present invention, it will be understood that various additions, modifications, and substitutions may be made therein without departing from the spirit and scope of the present invention or the principles thereof. For instance, it will be clear to those skilled in the art that the present invention may be embodied in other specific forms, structures, arrangements, proportions, and with other elements, materials, components, and otherwise, such as may be particularly adapted to specific environments and operative requirements, without departing from the spirit or essential characteristics thereof. While the disclosure is presented in terms of embodiments, it should be appreciated that the various separate features of the present invention need not all be present in order to achieve at least some of the desired characteristics and/or benefits of the present invention or such individual features. It will be appreciated that various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations, and features described with respect to one embodiment typically may be applied to another embodiment, whether or not explicitly indicated. Accordingly, individual features of any embodiment may be used and can be claimed separately or in combination with features of that embodiment or any other embodiment. Moreover, elements shown as integrally formed may be constructed of multiple parts or elements shown as multiple parts may be integrally formed, the operation of elements may be reversed or otherwise varied, the size or dimensions of the elements may be varied. Therefore, the present disclosure is not limited to only the embodiments specifically described herein. The presently disclosed embodiments are therefore to be considered in all respects as illustrative and not restrictive, the scope of the invention being indicated by the appended claims, and not limited to the foregoing description.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A blind, comprising:

a head rail having a bottom;

a rotatable tilt drum in said head rail, said tilt drum defining an oblong shape having a centroid, said oblong shape defining a major axis and a minor axis, said tilt drum being mounted for rotation about an axis of rotation that is offset from said centroid;

a front tilt cable extending from said tilt drum, out through said bottom of said head rail, and extending downwardly from said head rail;

a rear tilt cable extending from said tilt drum, out through said bottom of said head rail, and extending downwardly from said head rail;

a plurality of spaced apart rungs, including a top rung, each of said rungs being secured at a front rung end to said front tilt cable and at a rear rung end to said rear tilt cable; and a plurality of elongated slats, each of said slats defining an elongated, left-to-right slat direction and each slat having a front edge and a rear edge, and each slat resting on one of said rungs, with said front edge of each slat lying adjacent to said front tilt cable and said rear edge of each slat lying adjacent to said rear tilt cable;

wherein:

said major axis of said tilt drum is oriented in a substantially vertical direction when said slats are rotated to both a fully closed position and a fully opened position; and when said tilt drum is rotated to tilt said slats to said fully closed position, both said front and rear tilt cables extend in a straight line from said tilt drum, out through said bottom of said head rail, to said top rung, without being deflected by said head rail and with neither tilt cable being slack.

2. The blind as recited in claim 1, wherein:

said front and rear tilt cables are secured to said rotatable tilt drum and extend downwardly, away from said tilt drum at front and rear departure points, respectively; and when said blind is in said fully closed position, said front and rear departure points are spaced apart a front-to-rear horizontal distance that is no greater than said front-to-rear horizontal distance between said front and rear edges of said slats.

3. The blind as recited in claim 2, wherein said tilt drum rotates approximately 180 degrees to rotate said slats from said fully closed position to said fully opened position.

4. The blind as recited in claim 1, wherein:

said bottom of said head rail defines front and rear tilt-cable rout holes defining a minimum front-to-rear horizontal distance between said front and rear tilt-cable rout holes; and wherein said minimum front-to-rear horizontal distance between said front and rear tilt-cable rout holes is not greater than said front-to-rear horizontal distance between said front and rear edges of each slat when said tilt drum is rotated to tilt said slats to said fully closed position.

5. The blind as recited in claim 1, wherein said axis of rotation is offset at a higher elevation than said centroid when said blind is in said fully opened position.

6. The blind as recited in claim 1, wherein;

each of said slats defines a center of gravity; and said center of gravity of each of said slats remains at substantially the same elevation as said tilt drum is rotated from said fully opened position to said fully closed position.

7. The blind as recited in claim 1, wherein:

said front and rear tilt cables together exert a total force when rotating said slats from said fully opened position to said fully closed position and back to said fully opened position; and each of said front and rear tilt cables exerts between 40% and 60% of the total force exerted at every point from said fully open position to said fully closed position and back to said fully opened position.

8. The blind as recited in claim 7, wherein:

said bottom of said head rail defines front and rear tilt-cable rout holes defining a minimum front-to-rear horizontal distance between said front and rear tilt-cable rout holes; and said minimum front-to-rear horizontal distance between said front and rear tilt-cable rout holes is not greater than said front-to-rear horizontal distance between the said front and rear edges of each slat when said tilt drum is rotated to tilt said slats to said fully closed position.

9. A blind, comprising:

a head rail having a bottom;

a rotatable tilt drum housed in said head rail, said tilt drum defining an oblong shape having a centroid, said tilt drum being mounted for rotation about an axis of rotation that is offset from said centroid;

a front tilt cable extending from said tilt drum, out through said bottom of said head rail, and extending downwardly from said head rail;

a rear tilt cable extending from said tilt drum, out through said bottom of said head rail, and extending downwardly from said head rail;

a plurality of parallel rungs, including a top rung, each of said rungs being secured at a front rung end to said front tilt cable and at a rear rung end to said rear tilt cable; and a plurality of elongated slats, each of said slats defining a center of gravity, each of said slats further defining an elongated slat direction and resting on one of said rungs, with each slat having a front edge lying adjacent to said front tilt cable and a rear edge lying adjacent to said rear tilt cable;

wherein:

when said slats are moved to a fully closed position, said centroid is spaced apart from said axis of rotation in a first vertical direction by a given vertical distance; and when said slat are moved to a fully opened position, said centroid is spaced apart from said axis of rotation in a second vertical direction opposite the first vertical direction by substantially the same vertical distance.

10. The blind as recited in claim 9, wherein said axis of rotation is offset at a higher elevation than said centroid when said blind is in said fully opened position.

11. The blind as recited in claim 9, wherein:

said front and rear tilt cables are secured to said rotatable tilt drum and extend downwardly, away from said tilt drum at front and rear departure points, respectively; and when said blind is in said fully closed position, said front and rear departure points are spaced apart a front-to-rear horizontal distance that is no greater than a front-to-rear horizontal distance defined between said front and rear edges of said slats.

12. The blind as recited in claim 11, wherein, said front and rear tilt cables extend in a straight line from said front and rear departure points out through said bottom of said head rail, to said top rung, without being deflected by said head rail and with neither tilt cable being slack.

13. The blind as recited in claim 12, wherein:

said front and rear tilt cables together exert a total force when rotating said slats from said fully opened position to said fully closed position and back to said fully opened position; and each of said front and rear tilt cables exerts between 40% and 60% of the total force exerted at every point from said fully open position to said fully closed position and back to said fully opened position.

14. The blind as recited in claim 13, wherein:

said bottom of said head rail defines front and rear tilt-cable rout holes defining a minimum front-to-rear horizontal distance between said front and rear tilt-cable rout holes; and said minimum front-to-rear horizontal distance between said front and rear tilt-cable rout holes is not greater than a front-to-rear horizontal distance defined between said front and rear edges of each slat when said tilt drum is rotated to tilt said slats to said fully closed position.

15. A blind, comprising:

a head rail having a bottom;

a rotatable tilt drum in said head rail, said tilt drum defining an oblong shape having a centroid, said oblong shape defining a major axis and a minor axis, said tilt drum being mounted for rotation about an axis of rotation that is offset from said centroid;

a front tilt cable extending from said tilt drum, out through said bottom of said head rail, and extending downwardly from said head rail;

a rear tilt cable extending from said tilt drum, out through said bottom of said head rail, and extending downwardly from said head rail;

a plurality of parallel rungs, each of said rungs being secured at a front rung end to said front tilt cable and at a rear rung end to said rear tilt cable; and a plurality of elongated slats, each of said slats defining an elongated, left-to-right slat direction and each slat having a front edge and a rear edge, and each slat resting on one of said rungs, with said front edge of each slat lying adjacent to said front tilt cable and said rear edge of each slat lying adjacent to said rear tilt cable;

wherein said major axis of said tilt drum is oriented in a substantially vertical direction when said slats are rotated to both a fully closed position and a fully opened position.

16. The blind as recited in claim 15, wherein said axis of rotation is at a higher elevation than said centroid when said blind is in said fully opened position.

17. The blind as recited in claim 15, wherein:

said front and rear tilt cables are secured to said rotatable tilt drum and extend downwardly, away from said tilt drum at front and rear departure points, respectively;

when said blind is in said fully closed position, said front and rear departure points are spaced apart a front-to-rear horizontal distance that is no greater than a front-to-rear horizontal distance defined between said front and rear edges of said slats; and said front and rear tilt cables extend in a straight line from said front and rear departure points out through said bottom of said head rail, to said top rung, without being deflected by said head rail and with neither tilt cable being slack.

18. The blind as recited in claim 17, wherein said tilt drum rotates approximately 180 degrees to rotate said slats from said fully closed position to said fully opened position.

* * * * *